US009677206B2

(12) United States Patent
Lee et al.

(10) Patent No.: US 9,677,206 B2
(45) Date of Patent: Jun. 13, 2017

(54) FABRIC HAVING CUT-LOOP STRUCTURE, METHOD FOR MANUFACTURING SAME, AND PRODUCT USING FABRIC HAVING CUT-LOOP STRUCTURE

(71) Applicant: CLEMBON CO., LTD., Seoul (KR)

(72) Inventors: Hyun Sam Lee, Busan (KR); Sung Hoon Choi, Seoul (KR)

(73) Assignee: Clembon Co., Ltd., Seoul (KR)

( * ) Notice: Subject to any disclaimer, the term of this patent is extended or adjusted under 35 U.S.C. 154(b) by 162 days.

(21) Appl. No.: 14/368,659

(22) PCT Filed: May 3, 2013

(86) PCT No.: PCT/KR2013/003851

§ 371 (c)(1),
(2) Date: Jun. 25, 2014

(87) PCT Pub. No.: WO2014/046366

PCT Pub. Date: Mar. 27, 2014

(65) Prior Publication Data

US 2014/0373967 A1 Dec. 25, 2014

(30) Foreign Application Priority Data

Sep. 21, 2012 (KR) ..... 10-2012-0105096

(51) Int. Cl.
*D04B 1/04* (2006.01)
*D04B 21/04* (2006.01)
(Continued)

(52) U.S. Cl.
CPC ..... *D03D 27/02* (2013.01); *D02G 3/36* (2013.01); *D02G 3/44* (2013.01); *D03D 1/0023* (2013.01);
(Continued)

(58) Field of Classification Search
CPC ..... Y10T 428/23936; Y10T 428/23929; Y10T 428/2395; D03D 27/08; D03D 1/0023;
(Continued)

(56) References Cited

U.S. PATENT DOCUMENTS 2,979,803 A * 4/1961 Rollin ..... A41H 41/005 139/401
3,013,325 A * 12/1961 McNally ..... D03D 27/00 139/391
(Continued)

FOREIGN PATENT DOCUMENTS

JP 62053441 A * 3/1987
KR 19990015109 3/1999 ..... D03D 1/04
(Continued)

OTHER PUBLICATIONS

Machine translation of KR 10-0716623 B1, May 9, 2007.*
(Continued)

*Primary Examiner* — Cheryl Juska
(74) *Attorney, Agent, or Firm* — Sunstein Kann Murphy & Timbers LLP

(57) ABSTRACT

The present invention provides fabrics with cut loop pile comprising a synthetic filament core yarn and covering yarn of a split microfiber yarn and a viscose rayon yarn and a manufacturing method thereof. The core yarn at the section where said loops are cut is outwardly protruded from the covering yarn, wherein the synthetic multifilament core yarn is separated into multiple filaments to function as hooks. The fabrics with cut loop pile show superior characteristics in polishing properties, sliding properties, water absorption properties, rapid drying properties and feeling of touch owing to the split yarn of microfibers and the viscose rayon yarn which comprises the covering yarn, and polishing can be performed while easily catching foreign substances such as extremely minute dust particles or human hairs and the
(Continued)

like by the hook-shaped multifilaments of the core yarn. Thus the fabrics with cut loop pile according to the present invention can be used usefully in products such as various kind of mats, towels, bathroom products, and the like including dishcloths and mops.

16 Claims, 3 Drawing Sheets

(51) Int. Cl.

| | |
|---|---|
| ***D03D 27/02*** | (2006.01) |
| ***D02G 3/36*** | (2006.01) |
| ***D03D 1/00*** | (2006.01) |
| ***D03D 27/08*** | (2006.01) |
| ***D02G 3/44*** | (2006.01) |
| ***D06C 7/00*** | (2006.01) |
| ***D06C 11/00*** | (2006.01) |

(52) U.S. Cl.
CPC ..... *D03D 27/08* (2013.01); *D06C 7/00* (2013.01); *D06C 11/00* (2013.01); *D10B 2201/24* (2013.01); *D10B 2331/02* (2013.01); *D10B 2331/04* (2013.01)

(58) Field of Classification Search
CPC .. D02G 1/02; D02G 3/02; D02G 1/18; D02G 1/205; D02G 3/38; D06M 11/38; D04B 1/16; D06P 5/2006
USPC ..... 428/89, 88, 91; 57/3, 290, 210; 66/194; 139/2; 8/494, 115.7
See application file for complete search history.

(56) References Cited

U.S. PATENT DOCUMENTS

| | | | | |
|---|---|---|---|---|
| 3,066,380 | A * | 12/1962 | McNally | A41H 41/005 139/391 |
| 2006/0216458 | A1* | 9/2006 | Gilman | B32B 3/085 428/87 |
| 2014/0373967 | A1* | 12/2014 | Lee | D03D 1/0023 139/391 |
| 2015/0068639 | A1* | 3/2015 | Lee | D06M 11/38 139/396 |

FOREIGN PATENT DOCUMENTS

| | | | | |
|---|---|---|---|---|
| KR | 19990015109 | A | 3/1999 | D03D 1/04 |
| KR | 10716623 | B1 | 5/2007 | D03D 27/00 |
| KR | 100716623 | B1 | 5/2007 | D03D 27/00 |
| KR | 20110007037 | A | 1/2011 | D02G 3/12 |
| KR | 200453566 | Y | 5/2011 | A47L 13/16 |
| WO | WO 03087450 | | 10/2003 | |
| WO | WO 2014/046366 | | 3/2014 | D03D 27/00 |

OTHER PUBLICATIONS

Machine translation of KR 10-2004-0037881 A, May 8, 2004.*
Korean Intellectual Property Office, International Search Report for PCT/KR2013/003851, mailed Aug. 19, 2013, 4 pages.
Japanese Patent Office, Office Action for Japanese Patent Application No. 2014-548700, mailed Mar. 8, 2016 (5 pages).
Japanese Patent Office (English translation), Office Action for Japanese Patent Application No. 2014-548700, mailed Mar. 8, 2016 (6 pages).

* cited by examiner

FABRIC HAVING CUT-LOOP STRUCTURE, METHOD FOR MANUFACTURING SAME, AND PRODUCT USING FABRIC HAVING CUT-LOOP STRUCTURE

TECHNICAL FIELD

This invention relates to fabrics with cut loop pile, manufacturing method of fabrics, and the textile goods using the same.

BACKGROUND ART

Microfiber refers to fiber thinner than one denier which has a three dimensional structure and includes innumerable microspaces formed during the processes of dyeing and splitting, and thus, is excellent in water absorption, washing properties, feeling of touch and insulation. Dishclothes, mops, towels, gowns and the like, which are made of microfibers, get a good reputation owing to excellent washing properties, rapid-drying properties, excellent antibacterial and durable properties, and the like. Especially mops made of microfibers are gaining great popularity and widely used owing to advantages in that water absorption power thereof is more than five times higher, and efficiency and lifetime thereof are 7 to 8 times higher than that of the typical cotton mops in cleaning stubborn stains through absorption, and so on.

Mops generally utilize fabrics manufactured by cutting the loops obtained through knitting wherein yarns are organized and to have loop group therein. This is because the cleaning effect of the mops made of fabrics with uncut loop pile is decreased by pushing away foreign substances that are to be removed instead of catching them. In other words, in mops made of fabrics with cut loop group, foreign substances are removed by being caught between the cut loops thereby increasing the effect of removing foreign substances; this is the reason why most of mops adopt fabrics with cut loop pile therein.

However, when microfibers are used in manufacturing fabrics for mops with cut loop pile, there is an advantage that polishing properties may increase in the initial cleaning stage; since microfibers are extremely thin, the elastic repulsion is decreased therefore the elasticity and the elastic restoring force are degraded; so when microfibers absorb water or are pressed by the pressure during the cleaning process, there is a problem that cleaning efficiency is reduced by degradation of sliding properties due to the existence of the crumpled or tangled threads.

In order to solve above described problems, the inventor of the present invention has disclosed a technology in Korea Patent No. 716623 wherein a synthetic multifilament yarn is used as a core yarn, and splittable-microfiber yarns (also referred to herein as "splittable yarns of microfibers") are used as covering yarns which are being fixed to a core yarn through a heat treatment after twisting the microfibers of the covering yarn into the core yarn. When using the cleaning tools made of fabrics manufactured in such a way, it shows superior characteristics in polishing properties, sliding properties, water absorption properties, rapid drying properties, and feeling of touch compare to those of the cleaning tools using fabrics of the prior art. However, for the technology in the above mentioned Korea Patent No. 716623, there is a little room for improvement in catching extremely minute dust particles or human hairs, and the like.

SUMMARY OF INVENTION

Technical Problem

Accordingly, using a splittable yarn of microfibers and a viscose rayon yarn for a covering yarn, the inventor of the present invention have completed this invention after performing the research which allows maximization of the characteristics such as polishing properties, sliding properties, water absorption properties, rapid drying properties, feeling of touch, and the like because the split yarn of microfibers and the viscose rayon yarn, which comprises the covering yarn, can easily catch extremely minute dust particles or human hairs, and the like due to the outwardly protruding shape of the synthetic multifilament yarn, which is a core yarn, at the section where fabrics with cut loop pile are being cut.

An objective of the present invention is to provide a manufacturing method for fabrics with cut loop pile using a splittable yarn of microfibers and a viscose rayon yarn for a covering yarn, wherein the synthetic multifilament yarn, which is a core yarn, has an outwardly protruding shape at the section where fabrics with cut loop pile are being cut.

Another objective of the present invention is to provide fabrics with cut loop pile having a split yarn of microfibers and a viscose rayon yarn for a covering yarn, wherein the synthetic multifilament yarn, which is a core yarn, has an outwardly protruding shape at the section where fabrics with cut loop pile are cut.

Yet another objective of the present invention is to provide textile goods using fabrics with cut pile having a split yarn of microfibers and a viscose rayon yarn for a covering yarn, wherein the synthetic multifilament yarn, which is a core yarn, has an outwardly protruding shape at the section where fabrics with cut loop pile are cut.

Solution to Problem

To achieve above described objectives, the present invention provides a manufacturing method for fabrics with cut loop pile characterized in that: a synthetic multifilament yarn having total fineness within the range from about 100 denier to about 300 denier is used as a core yarn; and a splittable yarn of microfibers made of polyester and nylon having total fineness within the range from about 50 denier to about 300 denier and a viscose rayon having total fineness within the range from about 100 denier to about 300 denier are used for a covering yarn; and the method includes the steps of: a yarn manufacturing step for manufacturing a yarn having a structure of a core yarn where the covering yarn is fixed into through a heat treatment after twisting the covering yarn into said core yarn; a textile manufacturing step for knitting a textile using said yarn to include loop pile therein; a pre-fabric manufacturing step for manufacturing pre-fabrics having cut loops through raising and shearing of one surface or both surfaces of said textile; and a fabric manufacturing step for manufacturing fabrics wherein the core yarns are outwardly protruded from the covering yarns at the section where said loops are being cut by splitting, weight reduction, and shrinking of said covering yarns through treatment of said pre-fabrics in an alkaline solution for about 30 minutes to about 60 minutes at about 100° C. to about 130° C.

A dyeing step wherein dyeing is performed on said fabric manufactured in said fabric manufacturing step at a high temperature followed by washing and drying thereof may further included.

Said dyeing step may allow the cut section of the synthetic multifilament yarn, which is outwardly protruding from the section of the cut loops, to have a shape of a hook by being bent due to the heat after the heat treatment for about 30 minutes to about 60 minutes at about 100° C. to about 130° C.

The synthetic multifilament yarn in said yarn manufacturing step may be a multifilament yarn made of polyester or nylon. Preferably, said synthetic multifilament yarn may comprising between about 2 filaments and about 50 filaments.

Twisting yarn in said yarn manufacturing step may make a covering yarn have left-handed twist (Z-twist) and right-handed twist (S-twist) with reference to the core yarn for about 100 to about 1500 twists per meter (TPM) respectively.

In said yarn twisting, said splittable yarn of microfibers made of polyester and nylon may be twisted to have a right-handed twist (S-twist) and the viscose rayon yarn may be twisted to have a left-handed twist (Z-twist) with respect to the core yarn.

About 110° C. to about 130° C. heat may be applied for about 25 to about 50 minutes during the heating in said yarn manufacturing step.

The raising and shearing in said pre-fabric manufacturing step may make the length of the cut loop be from about 2 mm to about 30 mm.

Said treatment in alkaline solution in said fabric manufacturing step may make the length of the core yarn outwardly protruding from the covering yarn be from about 2 mm to about 5 mm.

In addition, the present invention provides fabrics with cut loop pile manufactured by the above described method characterized in that the core yarns at the section where said loops are being cut are outwardly protruded from the covering yarns.

In addition, the present invention provides fabrics with cut loop pile characterized in that: after organizing the yarns, textiles with cut loop piles are fabricated by knitting, then, the loops are being cut and alkaline treated to obtain fabrics; wherein, said yarns go through a yarn twisting process, wherein a covering yarn comprising a splittable yarn of microfibers made of polyester and nylon having total fineness within the range from about 50 denier to about 300 denier and a viscose rayon yarn having total fineness within the range from about 100 denier to about 300 denier, is twisted into a synthetic multifilament yarn, which is a core yarn, having total fineness within the range from about 100 denier to about 300 denier resulting in a structure where the covering yarn is fixed into the core yarn due to the applied heat; and the core yarn at the section where the loops are being cut has a shape outwardly protruded from the covering yarn.

In addition, the present invention provides textile goods characterized in that they are made by processing fabrics with cut loop pile manufactured in accordance with the above described present invention.

Above described textile goods may be any one selected from the group including dishclothes, mops, kitchen mats, bathroom mats, towel, bath gloves, and dandruff removers.

Advantageous Effects of Invention

Fabrics with cut loop pile manufactured in accordance with the above described present invention can polish while easily catching foreign substances such as extremely minute dust particles or human hairs, and the like since the synthetic multifilament yarn which is being separated into multiple filaments functions like a hook, wherein the synthetic multifilament yarn, which is a core yarn, has an outwardly protruding shape when the split yarn of microfibers, which is a covering yarn, has been shrunk at the section where the loops are being cut; and the yarn of split microfibers made of polyester and nylon, and the viscose rayon yarn, which comprises the covering yarn, show superior characteristics in polishing properties, sliding properties, water absorption properties, rapid drying properties, and feeling of touch. Thus, fabrics with cut loop pile manufactured in accordance with the present invention can be used usefully in the products such as various kind of mats, towels, bathroom products, and the like including dishclothes and mops.

DETAILED DESCRIPTION OF EMBODIMENT

Figure 1:
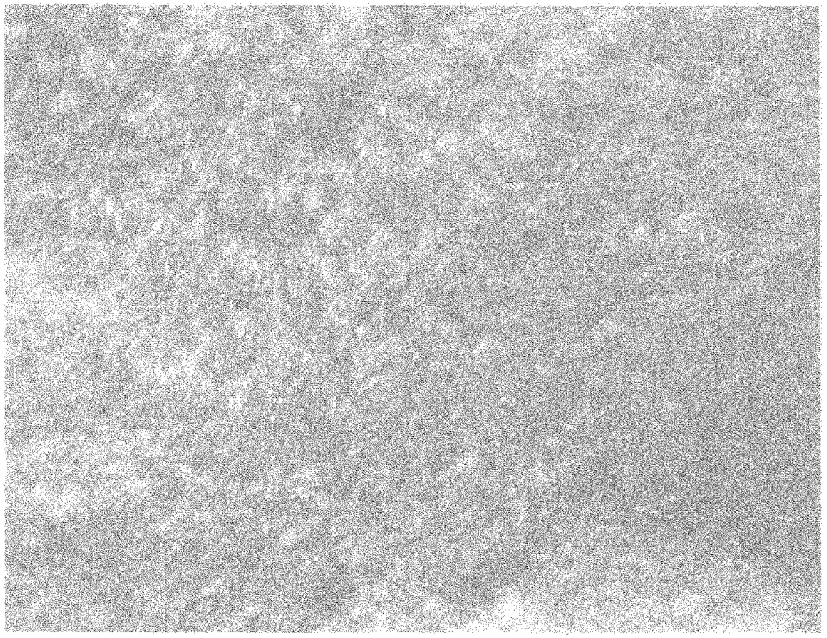
FIG. 1 is a photo showing the surface of fabrics manufactured in accordance with the present invention.

Hereinafter, the present invention will be described further in detail as follows.

Fabrics with cut loop pile according to the present invention have a shape wherein a synthetic multifilament yarn, which is a core yarn, at the section where the loops are being cut is outwardly protruding from the split yarn of microfibers made of polyester and nylon, and the viscose rayon yarn, which comprise a covering yarn.

In order to manufacture above described fabrics with cut loop pile, the present invention provides a manufacturing method of fabrics with cut loop pile including yarn manufacturing step, textile manufacturing step, pre-fabric manufacturing step, and fabric manufacturing step.

In said yarn manufacturing step, a synthetic multifilament yarn having total fineness within the range from about 100 denier to about 300 denier is used as a core yarn; and a splittable yarn of microfibers made of polyester and nylon having total fineness within the range from about 50 denier to about 300 denier and a viscose rayon yarn having total fineness within the range from about 100 denier to about 300 denier, are used for a covering yarn; after yarn twisting wherein the covering yarn is twisted into said core yarn is performed, heat is applied; thus, a yarn having a structure where the covering yarn is fixed into the core yarn is manufactured.

Said synthetic multifilament yarn, which is used as a core yarn of the original yarn, enhances elastic restoring force and elastic force by increasing the elastic repulsion coefficient of the cut loop in the manufactured fabrics. Thus, when the manufactured fabrics are used in mops, the cleaning efficiency degrading due to decrease in sliding properties can be prevented since the cut loops are immediately restored even they are pressed by the pressure during the cleaning process.

At this point, said synthetic multifilament yarn having total fineness within the range from about 100 to about 300 denier is used; if the total fineness of the synthetic multifilament yarn is less than 100 denier, elastic restoring force and elastic force of the cut loop are not sufficiently enhanced, so when the microfibers are pressed by the pressure during the cleaning process, they remain as being pressed thereby causing a problem of polishing properties degradation; if the total fineness exceeds 300 denier, there is a problem of scratches that may occur on the polishing surface while polishing.

Said synthetic multifilament yarn, which is used as a core yarn, may use a multifilament yarn made of various synthetic fibers known publicly including a polyester multifilament yarn or a nylon multifilament yarn. For said synthetic multifilament yarn, it is preferred to use a polyester multifilament yarn or a nylon multifilament yarn having superior elastic force and restoring force.

In addition, said synthetic multifilament yarn comprising between about 2 filaments and about 50 filaments may be used.

For example, the fineness of polyester multifilament yarns commercially available at this time are of 200 denier/10 filament, 300 denier/10 filament, 320 denier/8 filament, 300 denier/6 filament and so on; nylon multifilament yarns are of 180 denier/12 filament or 240 denier/12 filament and so on.

A split yarn of microfibers, which is used as a covering yarn, is located at the exterior of the cut loops of the manufactured fabric and enhances water absorption properties or rapid drying properties and feeling of touch. Thus, when the manufactured fabrics are used in cleaning or bath gown and the like, they would help in expressing superior water absorption properties and rapid drying properties, and good feeling of touch. The fineness of said splittable yarn of microfibers may not be necessarily limited; however, the one having total fineness within the range from about 50 denier to about 300 denier may be used considering water absorption properties or feeling of touch.

In here, a splittable yarn of microfibers means, as well known, a yarn that can be split into multiple microfibers using a chemical method or a physical method. For example, said splittable yarn of microfibers may be split into multiple microfibers using a chemical or a physical method after conjugate spinning the polymers of at least two components.

For such splittable yarn of microfibers, the one that are generally used in the art may be used without limitation, for example the one made of polyester and nylon may be used. For said splittable yarn of microfibers made of a composite of polyester and nylon, a commercially available one may be used, for example, a commercially available splittable yarn of microfibers comprising between about 70 wt % and about 80 wt % polyester and between about 20 wt % and about 30 wt % polyamide may be used.

In addition, the viscose rayon yarn, which is used for a covering yarn, is located outer area of the cut loops of the manufactured fabric so as to perform functions enhancing water absorption properties or rapid drying properties, dyeing properties and feeling of touch.

Thus, using the manufactured fabrics as a bath gown and the like is helpful in demonstrating superior water absorption properties and rapid drying properties, dyeing properties and feeling of touch. Although there is no need to necessarily limit the fineness of said viscose rayon yarn, the one having total fineness within the range from about 100 to about 300 denier may be used considering water absorption properties or feeling of touch and the like.

Said viscose rayon yarn usually can be obtained after making a viscose colloidal solution by properly treating plant-derived cellulose extracted from wood pulp, and reproducing it as a thread-like shape.

As such a viscose rayon yarn, any one generally used in the art may be used without limitation, for example, the one made of soluble plant-derived cellulose may be used.

According to the present invention, yarn twisting is performed using said synthetic multifilament yarn as a core yarn, and the splittable yarn of microfibers and a viscose rayon yarn as a covering yarn. Yarn twisting means combining and twisting more than two threads (yarns) into a single thread; in general, directions of the twist during the yarn twisting process are denoted by two types; the one that is twisted to left direction is called left-handed twist or Z-twist while the one that is twisted to right direction is called right-handed twist or S-twist. As for the machines used in such yarn twisting, ring twisters and fly twisters and the like are widely used.

Said yarn twisting may twist a covering yarn made of a splittable yarn of microfibers and a viscose rayon yarn with reference to the core yarn made of synthetic multifilament yarns to have about 100 TPM to about 1500 TPM with a left-handed twist (Z-twist) and a right-handed twist (S-twist). Preferably in said yarn twisting, said splittable yarn of microfibers made of polyester and nylon may be twisted to have a right-handed twist (S-twist) and the viscose rayon yarn may be twisted to have a left-handed twist (Z-twist) with respect to the core yarn.

Such yarn twisting can be accomplished by passing the synthetic multifilament yarn, which is a core yarn, through the tension device to the covering and compound twister. For example, a yarn twisting according to the present invention can be accomplished by performing: a first yarn twisting of a splittable yarn of microfibers with a polyester multifilament yarn using S-twist; and a second yarn twisting for applying Z-twist, which is opposite direction of the first yarn twisting, to the viscose rayon yarn, after the completion of S-twist. Such yarn twisting can be easily performed by applying publicly known technologies.

When the yarn twisting is completed, heat is applied to fix the covering yarn to the core yarn. In other words, heat is applied so as to prevent loosening of the twist by fixing the covering yarn to the core yarn. Above described heating may apply about 110° C. to about 130° C. heat for about 25 minutes to about 50 minutes.

When the yarn manufacturing step is completed, it goes through a textile manufacturing step. In the textile manufacturing step, a textile is manufactured by knitting said yarns to include a loop pile therein.

Including a loop pile during a textile manufacturing process can be easily performed by applying the publicly known technologies in the art. For example, a textile having a loop pile can be easily manufactured if yarns are organized prior to knitting in such a way that loops are formed when knitting on a circular knitting machine.

After completion of the textile manufacturing, it goes through a pre-fabric manufacturing step for manufacturing pre-fabrics having a structure where loops are being cut by raising and shearing either one surface or both surfaces of said textile.

Said raising means raising the loops, and said shearing means cutting the loops having the irregular length to have a uniform length; said raising and said shearing may be performed using a regular raising machine and a shearing machine.

According to the present invention, it is preferred that said raising and said shearing are performed such that the lengths of the cut loops are to be within the range from about 2 mm to about 30 mm considering the goods for applying the manufactured fabrics. In other words, shearing may be performed after adjusting the length of the loops being raised to match with the usage of fabrics manufactured according to the present invention. For example, when the manufactured fabrics are to be used for bathroom applications such as towels and the like, appropriate lengths of the cut loops are within the range from about 2 mm to about 5 mm; when the manufactured fabrics are to be used for kitchen applications such as sponges, gloves and the like, appropriate lengths of the cut loops are within the range from about 5 mm to about 8 mm; and when the manufactured fabrics are to be used for mops, appropriate lengths of the cut loops are within the range from about 8 mm to about 15 mm.

In this way, after going through the raising and the shearing processes, pre-fabrics with cut loops can be obtained.

After completion of the pre-fabric manufacturing step, it goes through a fabric manufacturing step for manufacturing fabrics, wherein said pre-fabrics are treated in alkaline solution for about 30 minutes to about 60 minutes at about 100° C. to about 130° C. such that said covering yarns are being split, weight reduction, and being shrunk; thus, the core yarns are outwardly protruded from the covering yarns at the section where said loops are being cut.

Treatment in an alkaline solution is for splitting, weight reduction, and shrinking of the covering yarn. During the process of alkaline treatment, polyester in the splittable yarn of microfibers of the covering yarn is partly hydrolyzed to produce soluble byproducts disodium terephthalate (DST) and ethylene glycol, and at this time polyamide (nylon) in the splittable yarn of microfibers of the covering yarn and the viscose rayon yarn are being separated. In other words, splitting, weight reduction, and shrinking of the covering yarn occur by the process of alkaline treatment. Especially shrinking of the covering yarn intensively occurs at the section where the loops are being cut therefore the core yarn at the section where the loops are being cut has an outwardly protruded covering yarn.

Any ordinary solution used in splitting and weight reduction of a splittable yarn of microfibers may be used as said alkaline solution without limitation, for example, sodium hydroxide (NaOH) may be used. For the alkaline solution treatment, the outwardly protruded length of the core yarn at the section where the loops are being cut is preferred to be within the range from about 2 mm to about 5 mm. When the core yarn's outwardly protruded length from the covering yarn has an above mentioned length, the synthetic multifilament yarn which is being separated into multiple filaments acts like a hook therefore it can polish while easily catching foreign substances such as extremely minute dust particles or human hairs, thus polishing properties and sliding properties are enhanced. When the protruded length of said core yarn is longer than 5 mm, there is a problem of causing lint due to too much weight reduction of the covering yarn; when the protruded length is shorter than 2 mm, there is a problem of reducing the capability of removing extremely minute dust particles or human hair and the like.

Said weight reduction is proportional to the concentration and the treatment temperature of alkaline solution, for example, sodium hydroxide (NaOH), and especially treatment temperature has a big effect thereon. In the present invention, it was performed at about 100° C. to about 130° C. heat for about 30 minutes to about 60 minutes considering shrinkage rate.

After solution treatment, it may go through a water-washing process for removing the produced byproducts of the hydrolysis process. Said water-washing process can be accomplished by performing the scouring process after removing foreign substances by spraying water to fabric including the weight deducted split yarn of microfibers. In said water-washing process, it is preferred to wash using about 70° C. to about 80° C. warm water avoiding quenching. Scouring is a process for removing foreign substances by injecting scouring agent during the water-washing operation; generally used sodium carbonate, sodium silicate and the like may be used; if necessary, tribasic sodium phosphate may be used for removing disodium terephthalate (DST).

When piece dyeing a fabric manufactured by alkaline solution treatment, acid treatment may be performed after the scouring of said water-washing process in order to facilitate dyeing process. Acid treatment process may be comprised of adjusting pH to be within the range from about 4 to about 5 using acid treatment agent RC Hydro (RC Cleaning, a product of Hansol Co. Ltd., in Korea) used for regular dyeing process.

According to the present invention, a dyeing step may further included for water-washing and drying the manufactured fabric in said fabric manufacturing step after performing dyeing process at high temperature.

Dyes may be comprised of dyes which are used for polyester microfibers or polyester and polyamide microfibers. For such dyes, dianix fla vaine xf, dianix red, cbn xf, (all these are the products of Distar, a multinational company) and the like can be named for examples. Various colors ranging from light colors to dark colors are available for dyeing.

Dyeing may be performed together with a dispersing agent, a leveling agent, a fiber softener, and an antimicrobial in addition to dyes when dyeing. Dyeing may also be performed together with chloroxylenol having excellent effect on removing virus.

Said dyeing step may be performed for about 30 minutes to about 60 minutes at about 100° C. to about 130° C. When dyeing is performed at such high temperature, the cut section of the synthetic multifilament yarn which is outwardly protruding from the section of the cut loops becomes a hook-like shape by bending due to the heat. Thus, when high temperature dyeing process is performed, the synthetic multifilament yarn which is being separated into multiple filaments acts like a hook therefore it can polish while easily catching foreign substances such as extremely minute dust particles or human hairs, thus polishing properties and sliding properties are enhanced.

Dyeing process may be performed either by a one-step process or by a two-step process where the polyamide and the viscose rayon yarn are dyed after dyeing the polyester.

The one-step process has shortcomings in that dye can be consumed in a three times larger amount than that in the two-step process, and dyeing failure can occur. Nevertheless, the one-step process can be considered because the two-step process is time-consuming and complicated. Two-step process is performed by dyeing the polyester with a disperse dye at 130° C., and then dyeing the polyamide and the viscose rayon yarn with a dye for polyamide and the viscose rayon yarn at 100° C. As the dye for polyamide and the viscose rayon yarn, a disperse dye or an acidic dye may be used.

A dyed fabric is obtained after completion of the dyeing process followed by water-washing and drying; said water-washing and drying may be easily performed by applying the methods which are generally performed in the field of dyeing fabric.

Fabrics manufactured in accordance with the present invention have a shape wherein the core yarns at the section where the loops are being cut are outwardly protruded from the covering yarns; and the synthetic multifilament yarn, which is said core yarn, is being separated into multiple filaments, and remains just as it is.

Figure 2:
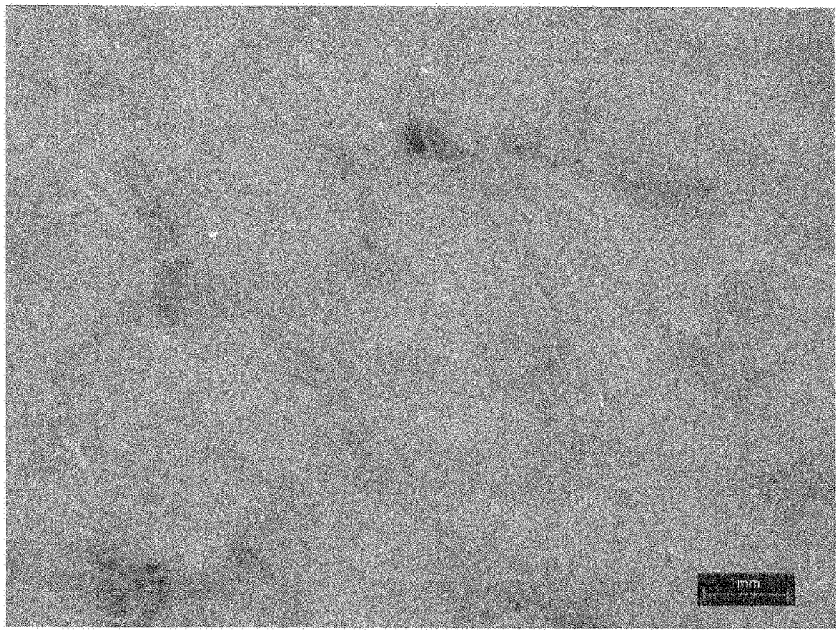
FIG. 2 is an enlarged photo of the surface of fabrics manufactured in accordance with the present invention.

FIG. 1 is a photo showing the surface of fabrics manufactured in accordance with the present invention; FIG. 2 is an enlarged photo of the surface of fabrics manufactured in accordance with the present invention; and FIG. 3 is a schematic view of the cut loop section of fabrics manufactured in accordance with the present invention.

Figure 3:
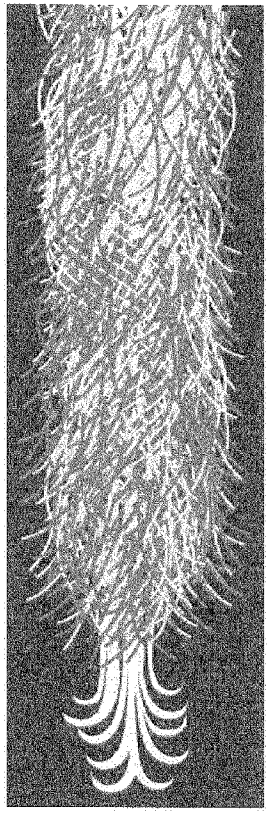
FIG. 3 is a schematic view of the cut loop section of fabrics manufactured in accordance with the present invention.

As shown in FIGS. 1 to 3, fabrics manufactured according to the present invention have shapes wherein the core yarns at the section where the loops are being cut are outwardly protruded from the covering yarns; and the synthetic multifilament yarn, which is said core yarn, remains as being separated into multiple filaments whose ends are being bent and have hook-like shapes.

Thus, when the core yarn has an outwardly protruding shape, the core yarn has sufficient restoring force and elastic force; thus, when fabrics are used for cleaning, even though they are pressed by a certain pressure, they are restored instantly; and even when water is being absorbed, sliding properties are not degraded therefore decrease in cleaning properties is prevented.

Especially, since the synthetic multifilament yarn, which is said core yarn, remains as being separated into multiple filaments and the ends thereof are being bent; thus, the synthetic multifilament yarn performs hook-like function and easily catches extremely minute dust particles or human hair and the like while polishing, hence, polishing properties and sliding properties are maximized. Besides, since the splittable yarn of microfibers, which is a covering yarn, is formed outside of the core yarn, water absorption properties, rapid drying properties and feeling of touch become excellent.

Thus, fabrics manufactured in accordance with the present invention can be used for various usages through processing after cutting them into predetermined sizes.

Accordingly, the present invention provides textile goods made through processing of fabrics with cut loop pile manufactured in accordance with the present invention.

Above described textile goods may be any one selected from the group including dishclothes, mops, kitchen mats, bathroom mats, towels, bath gloves, and dandruff removers.

For example, after the fabrics manufactured in accordance with the present invention are cut into pieces to have a predetermined size, they are used in making mops to have excellent polishing properties. Besides, said fabrics can be utilized for various usages such as mats installed in a bathroom or a kitchen, or golf lawns and the like. Especially when it is used as a mat installed in a bathroom or a kitchen, not only surroundings are kept clean by absorbing wetness from a wet body or scattered water during washing in the kitchen but also floor can be prevented from being slippery due to the wetness of dripping water; and there is an advantage in that since the elastic repulsion of the cut loop is high, the raised yarns are standing straight and have superior cushioning properties and good feeling of touch during the usage thereof.

Although hereinafter it will be explained more in detail through the exemplary embodiment described here below, this is merely provided to help to understand the present invention and not to limit the present invention to these examples.

Example 1

A polyester multifilament yarn of 300 denier/10 filament was used as a core yarn; a splittable yarn of microfibers made of 150 denier/72 filament nylon and polyester (each filament was 8 division type, comprised of 80 wt % and 20 wt % of polyester and polyamide respectively) was used as a covering yarn; and after the covering yarn was twisted with respect to the core yarn in S-twist and Z-twist respectively, 120° C. heat was applied for 40 minutes; thus, a yarn was manufactured. The yarn was twisted in a twister: firstly, it was twisted to have 600 TPM in S-twist, and secondly, it was twisted to have 540 TPM in Z-twist.

After the fabricated yarns were organized to have a loop group during the knitting on a circular knitting machine, the knitting process was performed; and after the raising process was performed, the shearing process was followed by; thus pre-fabrics having cut loop lengths of about 5 mm were manufactured. Said pre-fabrics were treated in sodium hydroxide solution (10 wt % NaOH was used) at 130° C. for 30 minutes; then, they were water-washed by spraying 60° C. warm water and scoured later using scouring agent. Then it was subjected to an acid treatment such that pH to be 4.5 using RC Hydro (a product of Hansol Co. Ltd., in Korea); then, dyeing was performed at 130° C. for 30 minutes in a dyeing bath together with a black dye Dianix Black (a product of Distar), a dispersing agent DC-505 (a product of Shin Kwang Chemical Ind. Co. Ltd.), an anti-static agent Anol-25B (a product of Shin Kwang Chemical Ind. Co. Ltd.), and a fiber softener 3M (a product of Shin Kwang Chemical Ind. Co. Ltd.); then, the water-washing and drying processes were followed by to obtain fabrics.

A photo of an enlarged surface of a manufactured fabric is shown in FIG. 2.

Example 2

Fabrics were manufactured using the same method in said Example 1 except that: a nylon multifilament yarn of 180 denier/12 filament was used as a core yarn; and, after the raising process was performed, the shearing process was followed by such that the lengths of cut loop were to be 8 mm.

Example 3

Fabrics were manufactured using the same method in said Example 1 except that: a polyester multifilament yarn of 320 denier/8 filament was used as a core yarn; and, after the raising process was performed, the shearing process was followed by such that the lengths of cut loop were to be 10 mm.

Example 4

Fabrics were manufactured using the same method in said Example 1 except that: a polyester multifilament yarn of 200 denier/10 filament was used as a core yarn; and, after the raising process was performed, the shearing process was followed by such that the lengths of cut loop were to be 8 mm.

Example 5

Fabrics were manufactured using the same method in said Example 1 except that pre-fabrics were treated in sodium hydroxide solution (7 wt % NaOH) at 120° C. for 40 minutes.

Comparison Example 1

A polyester multifilament yarn of 300 denier/10 filament was used as a core yarn; a splittable yarn of microfibers made of 150 denier/72 filament nylon and polyester (each filament was 8 division type, comprised of 80 wt % and 20 wt % of polyester and polyamide respectively) was used as a covering yarn; and after the covering yarn was twisted with respect to the core yarn in S-twist and Z-twist respectively, 120° C. heat was applied for 40 minutes; thus, a yarn was manufactured. The yarn was twisted in a twister: firstly, it was twisted to have 600 TPM in S-twist, and secondly, it was twisted to have 540 TPM in Z-twist.

After the manufactured yarns were organized on a circular knitting machine so as to have loop pile, knitting was performed; then, the raising process and the shearing process were performed to obtain fabrics with cut loops of 8 mm in length.

Experiment Example

After the fabrics manufactured according to the above described Examples 1 to 4 and Comparison Example 1 were cut into squares, the edges were finished; then, mops were made; characteristics in polishing properties, sliding properties, restoring properties, water absorption properties, rapid drying properties, and feeling of touch of the fabricated mops were evaluated in accordance with following method and the results are shown in Table 1.

—Polishing Properties—

On each floor paper that is 2 meters wide and 2 meters long, 50 ml of coffee was poured and polished by a mop; then it was visually inspected by 30 house wives who were 30 to 40 years old and they evaluated the polishing properties in three grade levels: good, fair, and poor.

—Sliding Properties—

After 100 ml of water was poured into a mop, and 30 house wives who were 30 to 40 years old mopped the floor papers that were 2 meters wide and 2 meters long; they evaluated sliding properties in three grade levels: good, fair, and poor.

—Restoring Properties—

10 kg of weight (10×200×200 mm) was laid on the surface of a mop for 30 seconds and removed; then, after 30 seconds were elapsed, the surface was visually inspected and the restoring properties was evaluated as 'good' if the cut loops were restored, and as 'poor' if they were remained as pressed.

—Water Absorption Properties—

After the mop was cut into pieces to have 2 cm in width, the water absorption properties were evaluated by measuring time required to rise 1 cm while 1 cm of the lower part was being dipped in water.

—Drying Properties—

After the weight of the mop was measured, 10 g of water was poured on the surface thereof and dried at a room temperature; the drying properties were evaluated by measuring time required to reach to the initial weight of the mop.

—Feeling of Touch—

After 30 house wives who were 30 to 40 years old touched the surface of a mop, the feeling of touch was evaluated in grade levels of excellent (5 points), good (4 points), fair (3 points), poor (2 points), very poor (1 point); then, the point values were averaged.

—Wash Fastness—

Performed in accordance with a method specified in Korean Standards KS K ISO 105-001:207 (40±2° C., 30 minutes, 1% spark).

TABLE 1

| Property | | Example 1 | Example 2 | Example 2 | Example 4 | Example 5 | Comparison Example 1 |
|---|---|---|---|---|---|---|---|
| Polishing property (Number of people) | Good | 26 | 28 | 27 | 27 | 28 | 17 |
| | Fair | 4 | 2 | 3 | 3 | 2 | 10 |
| | Poor | 0 | 0 | 0 | 0 | 0 | 3 |
| Sliding properties (Number of people) | Good | 27 | 28 | 28 | 27 | 28 | 19 |
| | Fair | 3 | 2 | 2 | 3 | 2 | 10 |
| | Poor | 0 | 0 | 0 | 0 | 0 | 1 |
| Restoring property | | Good | Good | Good | Good | Good | Good |
| Water absorption property (sec) | | 1.1 | 1.0 | 1.0 | 1.3 | 0.9 | 2.2 |
| Rapid drying property (min) | | 175 | 180 | 180 | 175 | 180 | 180 |
| Feeling of touch | | 4.8 | 4.6 | 4.5 | 4.6 | 4.8 | 3.6 |
| Wash fastness (level) | Color fastness | 4-5 | 4-5 | 4-5 | 4-5 | 4-5 | — |
| | Contamination (polyester) | 4-5 | 4-5 | 4-5 | 4-5 | 4-5 | — |

As shown in Table 1 above, it can be verified that not only the polishing properties and the sliding properties but also the feeling of touch of the mops manufactured using the fabrics in Examples 1 to 5 manufactured in accordance with the present invention are superior to that of the mops manufactured using the fabrics in Comparison Example 1 manufactured in accordance with the prior art.

What is claimed is:

1. A manufacturing method for fabrics with cut loop pile, the method characterized in that: a synthetic multifilament yarn having total fineness within the range from about 100 denier to about 300 denier is used as a core yarn; and a splittable-microfiber yarn made of polyester and nylon having total fineness within the range from about 50 denier to about 300 denier and a viscose rayon yarn having total fineness within the range from about 100 denier to about 300 denier, are used for a covering yarn; and the method includes the steps of:

a yarn manufacturing step for manufacturing a yarn having a structure of a core yarn where the covering yarn is fixed into through a heat treatment after twisting the covering yarn into said core yarn;

a textile manufacturing step for knitting a textile using said yarn to include loop pile therein;

a pre-fabric manufacturing step for manufacturing pre-fabrics having cut loops through raising and shearing of one surface or both surfaces of said textile;

a fabric manufacturing step for manufacturing fabrics wherein the core yarns are outwardly protruded from the covering yarns at the section where said loops are being cut by splitting, weight reduction, and shrinking of said covering yarns through treatment of said pre-fabrics in an alkaline solution for about 30 minutes to about 60 minutes at about 100° C. to about 130° C. to produce soluble byproducts from the partial hydrolysis of the polyester of the covering yarns followed by washing the byproducts away; and a dyeing step wherein dyeing is performed on said fabric manufactured in said fabric manufacturing step for about 30 minutes to about 60 minutes at about 100° C. to about 130° C. followed by washing and drying to allow the cut section of the synthetic multifilament yarn, which is outwardly protruding from the section of the cut loops, to have a shape of a hook by being bent.

2. The method of claim 1, characterized in that the synthetic multifilament yarn in said yarn manufacturing step is a multifilament yarn made of polyester or nylon.

3. The method of claim 2, characterized in that said synthetic multifilament yarn comprises between about 2 filaments and about 50 filaments.

4. The method of claim 1, characterized in that twisting yarn in said yarn manufacturing step is making a covering yarn have left-handed twist (Z-twist) and right-handed twist (S-twist) with reference to the core yarn for about 100 to about 1500 twists per meter (TPM) respectively.

5. The method of claim 4, characterized in that in said yarn twisting, said splittable-microfiber yarn made of polyester and nylon is twisted to have a right-handed twist (S-twist) and the viscose rayon yarn is twisted to have a left-handed twist (Z-twist) with respect to the core yarn.

6. The method of claim 1, characterized in that about 110° C. to about 130° C. heat is applied for about 25 to about 50 minutes during the heating in said yarn manufacturing step.

7. The method of claim 1, characterized in that the raising and shearing in said pre-fabric manufacturing step makes the length of the cut loop be from about 2 mm to about 30 mm.

8. The method of claim 1, characterized in that said treatment in alkaline solution in said fabric manufacturing step is making the length of the core yarn outwardly protruding from the covering yarn be from about 2 mm to about 5 mm.

9. A fabric with cut loop pile manufactured using a method in claim 1, characterized in that the core yarn, at the section where said loops are being cut, is outwardly protruded from the covering yarns.

10. A fabric with cut loop pile manufactured using a method in claim 2, characterized in that the core yarn, at the section where said loops are being cut, is outwardly protruded from the covering yarns.

11. A fabric with cut loop pile manufactured using a method in claim 4, characterized in that the core yarn, at the section where said loops are being cut, is outwardly protruded from the covering yarns.

12. A fabric with cut loop pile manufactured using a method in claim 6, characterized in that the core yarn, at the section where said loops are being cut, is outwardly protruded from the covering yarns.

13. A fabric with cut loop pile manufactured using a method in claim 7, characterized in that the core yarn, at the section where said loops are being cut, is outwardly protruded from the covering yarns.

14. A fabric with cut loop pile manufactured using a method in claim 8, characterized in that the core yarn, at the section where said loops are being cut, is outwardly protruded from the covering yarns.

15. A textile product characterized in that the product is made by cutting the fabric with cut loop pile according to claim 9 into predetermined sizes and finishing the cut edges.

16. The textile product in claim 15, characterized in that said product is a selected one from a group including dishclothes, mops, kitchen mats, bathroom mats, towels, bath gloves, and dandruff removers.

* * * * *